United States Patent [19]

Frank

[11] Patent Number: 4,976,651

[45] Date of Patent: Dec. 11, 1990

[54] CLACKER APPARATUS

[76] Inventor: Barry M. Frank, 13610 N. Scottsdale Rd., #10-241, Scottsdale, Ariz. 85254

[21] Appl. No.: 289,682

[22] Filed: Dec. 27, 1988

[51] Int. Cl.[5] ..... A63H 5/00; G10D 13/08

[52] U.S. Cl. ..... 446/421; 446/397; 84/402

[58] Field of Search ..... 446/397, 418, 421, 422, 446/489; 84/402, 404

[56] References Cited

U.S. PATENT DOCUMENTS

| | | | |
|---|---|---|---|
| 90,832 | 6/1869 | Fessenden | 446/421 |
| 166,344 | 8/1875 | Crandall | 84/402 |
| 237,850 | 2/1881 | Fisher | 84/402 X |
| 427,274 | 5/1890 | Sherman | 335/28 |
| 465,066 | 12/1891 | Murphy | 496/421 |
| 823,713 | 6/1906 | Chein | 446/422 |
| 976,718 | 11/1910 | Bartholomae | 446/422 |
| 1,438,304 | 12/1922 | Goldberg et al. | 446/418 |
| 1,567,803 | 12/1925 | Ludwig | 84/402 X |
| 1,711,309 | 4/1929 | Escovar | 84/402 X |
| 2,280,582 | 11/1940 | Hoeflich | 446/422 |
| 2,386,561 | 10/1945 | Magnuson | 446/421 |
| 3,170,360 | 2/1965 | Miettinen | 84/402 X |
| 3,783,733 | 1/1974 | Zirimis | 446/421 |
| 4,019,277 | 4/1977 | Kenkelen | 446/418 X |
| 4,463,517 | 8/1984 | Kerr et al. | 446/421 |

*Primary Examiner*—Robert A. Hafer
*Assistant Examiner*—D. N. Muir
*Attorney, Agent, or Firm*—H. Gordon Shields

[57] ABSTRACT

Clacker apparatus includes a base portion, including a handle, and one or two clacker elements secured to the base element. The clacker elements are secured by means of a rivet or the like, and the elements are freely movable relative to each other to allow the clacker elements to contact the base element over substantially the entire area. The bottom of the base element may include an aperture for receiving streamers or a chain.

20 Claims, 1 Drawing Sheet

CLACKER APPARATUS

BACKGROUND OF THE INVENTION

1. Field of the Invention:

This invention relates to a novelty noise making apparatus and, more particularly, to a clacker apparatus designed to make a noise as the apparatus is shaken.

2. Description of the Prior Art:

U.S. Pat. No. 166,344 (Crandall) discloses a castanet with a handle section and fixed elements extending in opposite directions from the center handle section. A pair of plates is pivotally secured to each end element for contacting the end elements as the handle is shaken or moved by a user.

U.S. Pat. No. 427,274 (Sherman) discloses a hand clacker which includes a central plate and spring elements are secured to the plate. At the other ends of the spring elements are hammer elements. The hammer elements contact the central plate as the central plate is shaken, and noise is generated.

U.S. Pat. No. 823,713 (Chein) discloses a toy noise maker which includes spring elements secured on opposite sides of a central plate. The spring elements also have hammers at their outer ends for making noise as the central element is shaken.

U.S. Pat. No. 1,567,803 (Ludwing) discloses a castanet apparatus in which castanets pivotally are secured to opposite sides of a central plate, and jingle elements comprising opposite pairs of elements, are also secured on opposite sides of the plate. The jingle elements impinge on each other, as opposed to contacting the plate.

U.S. Pat. No. 2,280,582 (Hoeflich) disclosed a method of making a noise maker. The nose maker is structurally similar to the apparatus of the '713 (Chein) patent.

U.S. Pat. No. 2,386,561 (Magnuson) discloses a rattle which includes a central element having an aperture therethrough. A cross bar extends through the aperture and a pair of clacker elements is pivotally secured to the central element by means of pins extending through the cross bar. The cross bar extends through openings in the clapper elements and the pins in the cross bar hold the clapper elements, the cross, bar, and the central element together.

U.S. Pat. No. 3,170,360 (Miettinen) discloses a clapper apparatus including a single clapper element pivotally secured to a handle.

U.S. Pat. No. 3,783,733 (Zirimis) discloses a sound emitting instrument including a handle and a clapper element pivotally secured to the handle. The clapper element pivots to contact the handle to make noise.

U.S. Pat. No. 4,019,277 (Kenkelen) discloses a combination fan and noise maker. Three elements are loosely secured together at one end of the three separate elements. They may be fanned apart to form a fan, or they can be shaken so that they rattle by impinging on each other.

U.S. Pat. No. 4,463,517 (Kerr et al) discloses a noise maker having a central element and elements hinged on opposite sides of the central element. The apparatus also includes a handle, and when the handle is shaken, the hinged elements contact the central element to make noise.

It will be noted that the prior art elements are generally hinged in some manner so that they contact a center, fixed element through a pivoting action. The primary exception to that type of contact and noise generation is disclosed in the '803 (Ludwing) patent in which jingle elements are secured together by means of a center screw or stud. The jingle elements contact each other, and not a central element.

It will also be noted that the prior art noise making patents disclose pivoting elements generally secured to a base or central elements by means of a single pin, or spring, or the like.

The noise making apparatus of the present invention utilizes a different technique to make noise by providing that clacker elements can move freely to contact a central element over substantially the entire area of the central element and the movable element.

SUMMARY OF THE INVENTION

The invention described and claimed herein comprises clacker apparatus having a central element which combines the functions of a handle and a fixed clacker plate and one or two movable clacker plates are secured to the fixed clacker element by means of a movable fastening element, such as by a rivet, which moves freely relative to the other elements, thus alowing the clacker elements to move freely with respect to each other, including the fixed clacker element, and to the fastening element.

Among the objects of the present invention are the following:

- To provide new and useful noise making apparatus;
- To provide new and useful clacker apparatus having a base element and a clacker element movable relative to the base element;
- To provide new and useful clacker apparatus having a fixed base element and a pair of clacker elements secured on opposite sides of the base element;
- To provide new and useful clacker apparatus having a base clacker element and a movable clacker element secured to the base element by a pair of fastening elements; and
- To provide new and useful clacker apparatus having a handle secured to a clacker element and an aperture extends through the handle element for receiving a non-clacker element.

DESCRIPTION OF THE PREFERRED EMBODIMENT

Figure 1:
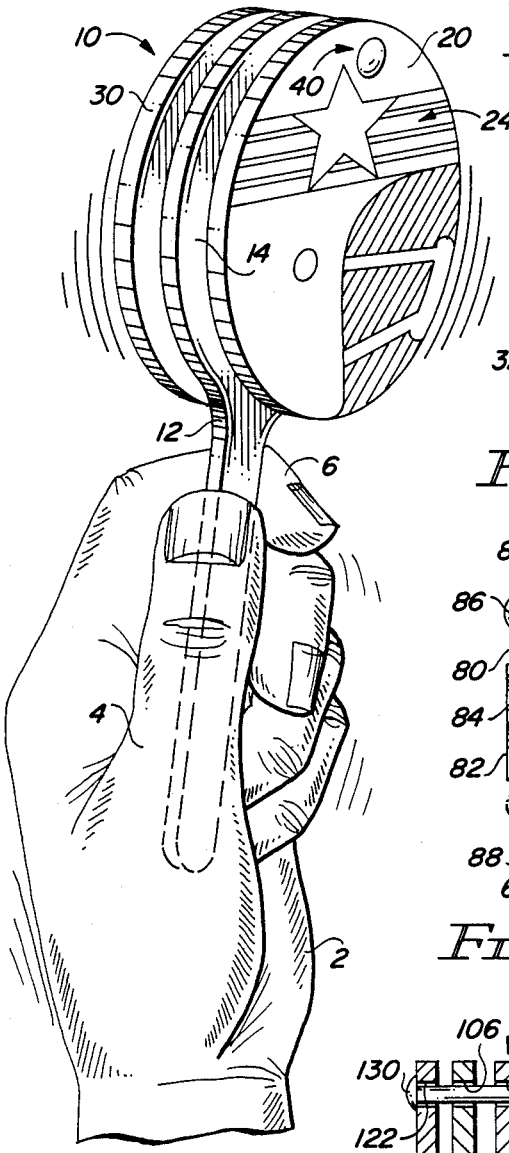
FIG. 1 is a perspective view illustrating the operation of the apparatus of the present invention.
Figure 2:
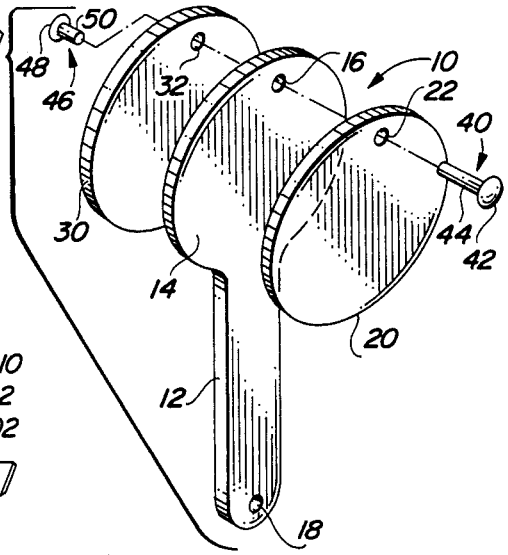
FIG. 2 is an exploded perspective view of the apparatus of the present invention.

FIG. 1 is a perspective view of clacker apparatus 10 of the present invention in its use environment. FIG. 2 is an exploded perspective view of the clacker apparatus 10 of FIG. 1. For the following discussion of clacker apparatus 10, attention will be directed to both FIGS. 1 and 2.

FIG. 1, a hand 2 is shown graspin tyhe clacker apparatus 10 between a thumb 4 and a forefinger 6. The clacker apparatus 10 is designed to be shaken or vibrated by a user for purposes of producing a clacking sound. The clacking sound is an alternative to clapping ones hands, yelling, screaming, etc. Or, on the other hand, the clacker sound may be in addition to other noises, such as yelling, shouting, etc.

The clacker apparatus 10 includes a handle 12 and a central or base clacker element 14 secured to the handle. In FIGS. 1 and 2, and in other figures, the clacker apparatus 10, and alternate embodiments thereof, are all shown with a handle and a central or base clacker element. While the central clacker element is generally illustrated as circular, it may be any appropriate configuration. Different configuration will be discussed below in conjunction with alternate embodiments.

The central clacker element 14 includes an aperture 16 extending through the clacker element generally centrally located, or on a longitudinal axis of the handle 12 and the central clacker element 14. The aperture 16 is also located adjacent to the top of the apparatus, or remote from the handle 12.

In addition to the central or fixed clacker element 14, two additional movable clacker elements, including an element 20 and an element 30, are appropriately secured on opposite sides of the central clacker element 14. The outer clacker elements 20 and 30 are shown as being circular and as having the approximate size as the central clacker element 14. However, if desired, they could be larger, smaller, or each could be a different size. The outer clacker elements face the central or center clacker element and impinge on the outer surfaces or faces of the central clacker element to provide a clacking sound.

The clacker element 20 includes an aperture 22, and the clacker element 30 includes an aperture 32. The aperture 16, 22, and 32 are appropriately aligned with each other and the three clacker elements are then appropriately secured together. A fastening element 40 is used to secure the elements 20, 14, and 30 together. The fastening element 40 is illustrated as a two-piece fastener. Typically, the fastener element 40 may be a one-piece rivet, with two heads. In such case, the overall length of the rivet between its heads should be longer than the combined width or thickness of the three clacker elements so that the outer elements 20 and 30 may move freely as the apparatus is shaken. It is, of course, the relative movement of the clacker elements 20 and 30 with respect to the central clacker element 14 that produces the clacking sound as the clacker elements impinge on or contact the central element 14.

The handle 12 also includes and aperture 18 adjacent to the bottom of the handle, remote from the central clacker element 14. The aperture 18 is for fastening ribbons, key rings, etc., onto the clacker apparatus.

In FIG. 2, the fastening element 40 is shown as including a head portion 42 and a shaft or shank 44. A second fastening element 46 also includes a head 48 and a shaft or shank 50. The shank or shaft portion 44 of the fastening element 40 may be internally threaded, and the shaft or shank 50 may be externally threaded so as to mate with the element 40. If plastic fastening elements are used, they may be solvent welded together, etc. The manner in which the fastening elements are secured together is well known and understood in the art. Moreover, the particular type of fastening element used is a mater of choice. Obviously, the heads 42 and 48 are larger in diameter than the diameter of the apertures 22, 16, and 32. Similarly, it is obvious that the diameters of the shank portions 44 and 46 will be less in diameter than the diameters of the apertures 22, 16, and 32. With the various elements appropriately dimensioned, the outer clacker elements 22 and 30 move freely as the apparatus 10 is shaken.

Figure 3:
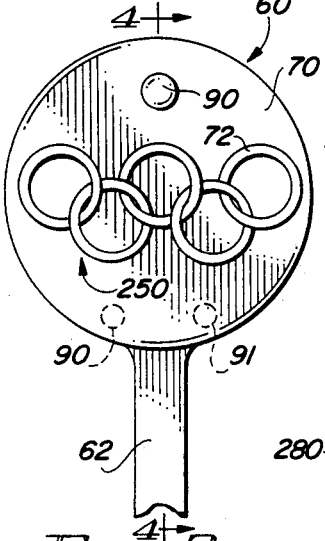
FIG. 3 is a front view of an alternate embodiment of the apparatus of the present invention.

FIG. 3 is a front view of an alternate embodiment of the apparatus of the present invention. It comprises a front view of clacker apparatus 60.

Figure 4:
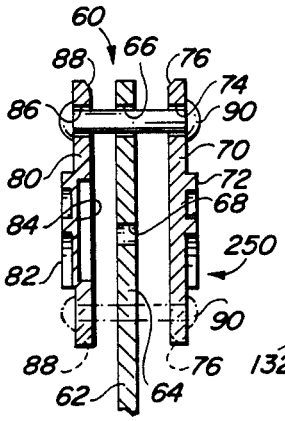

FIG. 4 is a view in partial section of clacker apparatus 60 of FIG. 3, taken generally along line 4—4 of FIG. 3. For the following discussion, attention will be directed to FIGS. 3 and 4.

Clacker apparatus 60 is very similar to clacker apparatus 10 discussed above. However, clacker apparatus 60 utilizes slightly different configurations in the clacker elements. Clacker apparatus 60 includes a handle 62 and a central clacker element 64. A pair of outer clacker elements 70 and 80 is appropriately secured to the central clacker element 64 by means of an appropriate fastening element 90. The central clacker element 64 includes an aperture 66 adjacent to the top of the clacker element 64. The fastening element 90 extends through the aperture 66 and through aligned apertures in the clacker elements 70 and 80.

A sound enhancing aperture 68 extends through the central portion of the element 64.

Clacker element 70, an outer clacker element, is generally circular in configuration, as is the central clacker element 64. However, clacker element 70 includes an outwardly extending boss 72. The boss 72 may be considered as a sound boss to provide a different type of sound than what might otherwise be provided by a generally flat or planar apparatus, such as the clacker elements 20 and 30 of FIGS. 1 and 2. The boss 72 is incorporated into an appropriate design. Or, put another way, an appropriate design may be incorporated in to a boss. As shown, the boss 72 comprises a design of five interlocked circles.

Clacker element 70 includes an aperture 74 adjacent to the top of the clacker element. The fastening element 90 extends through the aperture 74. A bevelled edge 76 is disposed adjacent to the aperture 74.

The purpose of the bevelled edge is to enhance the pivoting of the element 70. The bevel allows the clacker to pivot through a greater arcuate distance than would be possible without the bevel.

The clacker element 80 is also circular in configuration. Like the clacker element 70, it includes an outwardly extending boss 82. However, the clacker element 80 also includes an inner relieved portion 84. The relieved portion 84 helps to provide a different sound as the clacker 80 impinges on the central clacker element 64. Also, the boss 82 helps to alter the sound, and allows the relieved portion 84 to extend deeper than might otherwise be possible. The relieved portion 84 is aligned with the aperture 68.

It is obvious that the clacker element 70 may also include a relieved portion for sound enhancement, if desired.

A bevelled edge 88 is diposed adjacent to the aperture 86. The bevelled edge 88 serves the same purpose for the clacker element 80 as the bevelled edge 76 does for the clacker element 70.

Figure 5:
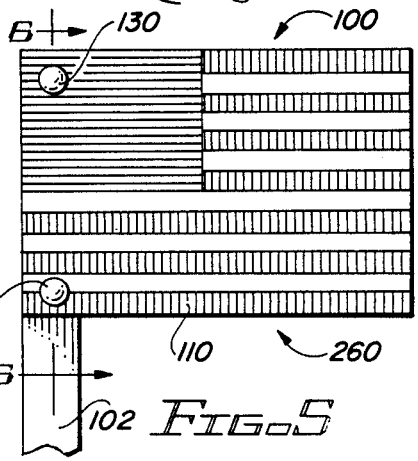
FIG. 5 is a front view of an alternate embodiment of the apparatus of the present invention.
Figure 6:
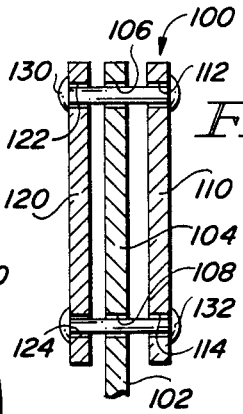
FIG. 6 is a view in partial section taken generally along line 6—6 of FIG. 5.

FIG. 5 is a front view of another alternate embodiment of clacker apparatus of the present invention. It comprises a front view of clacker apparatus 100. FIG. 6 is a view in partial section taken generally along line 6—6 of FIG. 5. For the following discussion, attention will be directed to FIGS. 5 and 6.

Clacker apparatus 100 includes a handle 102 and a central clacker element 104 secured to the handle 102. the clacker element 104 is preferably rectangular in configuration. While the handle may be disposed as desired with respect to the central clacker element 64, due to the nature of the overall configuration of the clacker apparatus 100, the handle 102 is preferably oriented at one end so as to provide an overall flag effect for the clacker apparatus 100.

The central clacker element 104 includes two apertures, an upper aperture 106 and a lower aperture 108. The apertures 106 and 108 are aligned with each other and are generally centrally located with respect to the longitudinal axis of the handle 102 simply for convenience. A pair rectangularly configured clacker elements 110 and 120 are disposed on opposite sides of the central clacker element 104. The surface of the clacker elements 110 and 120 are generally planar, as are the surfaces of the central clacker element 104.

The clacker element 110 includes an aperture 112 and an aperture 114. The aperture 112 is an upper aperture and the aperture 114 is a lower aperture. Similarly, the clacker element 120 includes an upper aperture 112 and a lower aperture 124. The apertures 112, 106, and 122 are aligned with each other, and an upper fastener element 130 is inserted through the aligned apertures to hold the upper portions of the three clacker elements.

A fastening element 132 extends through the aligned lower apertures 114, 108, and 124. As with the other clacker apparatus described herein, the apertures are substantially larger in diameter than are the shanks of the fastening elements utilized to secure the clacker elements together. And, similarly, the overall length of the fastening elements is greater than the combined width or thickness of the clacker elements to allow movement of the outer clacker elements relative to the central clacker element, unimpeded by a tight fit, to enhance sound production, etc.

Figure 7:
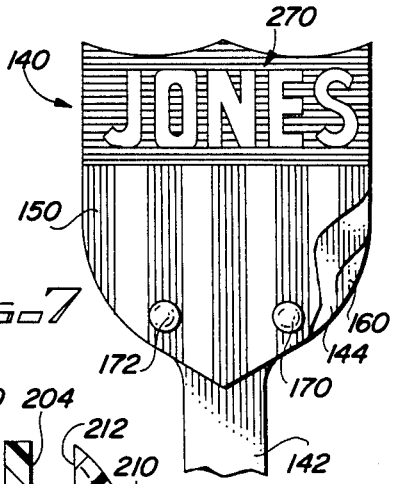
FIG. 7 is a front view of an alternate embodiment of the apparatus of the present invention.

FIG. 7 is a front view of an alternate embodiment of the apparatus of the present invention. It comprises a front view of clacker apparatus 140. The clacker apparatus 140 includes a handle 142 and a central or base clacker element 144. A pair of clacker elements 150 and 160 are appropriately secured by a pair of fastening elements 170 and 172 to the central clacker element 144. The fastener elements 170 and 172 are disposed toward the bottom of the clacker elements 144, 150, and 160.

It will be noted that the configuration of the clacker elements 144, 150, and 160 is generally in the shape of a shield. Obviously, any general configuration may be utilized, such as round, rectangular, oval, oblong, etc. Again, as discussed above, the clacker elements include apertures, appropriately aligned with each other, for receiving the fastening elements 170 and 172.

Returning again to FIG. 4, the fastening element 90 is shown in phantom at the bottom or lower portion of the clacker elements 70 and 80 and extending through the bottom or lower portion of the control clacker element 64. The bevels 76 and 88 are also shown in phantom at the bottom of the other clacker elements 70 and 80 and adjacent to the fastener 90. The purpose of the phantom or dotted line showing is to illustrate that the bottom fastening of the clacker apparatus 140 is also appropriate for any other clacker apparatus, such as the apparatus 60, etc. However, as shown in FIG. 3, and as discussed for the apparatus 140 of FIG. 7, the bottom fastening of the outer clacker elements requires two fastener elements. In FIG. 3, a second bottom fastener element 91 is shown with the fastener 90, both of which are shown in phantom at the bottom or lower portion of the clacker element 70.

Figure 8:
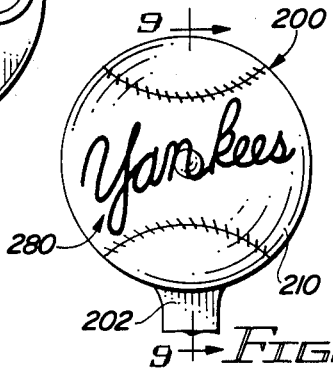
FIG. 8 is a front view of another alternate embodiment of the apparatus of the present invention.
Figure 9:
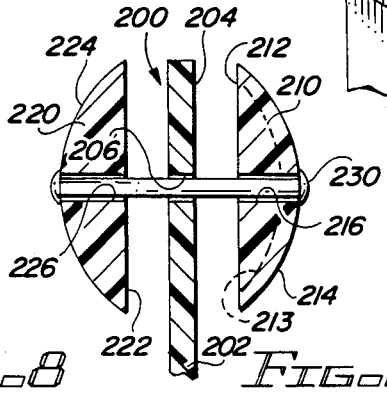
FIG. 9 is a view in partial section taken generally along line 9—9 of FIG. 8.

FIG. 8 is a front view of another alternate embodiment of the apparatus of the present invention of clacker apparatus 200. FIG. 9 is a view in partial section of clacker apparatus 200 taken generally along line 9—9 of FIG. 8. For the following discussion, reference will be made to FIGS. 8 and 9.

Clacker apparatus 200 includes a handle 202 and a central or base clacker element 204. The clacker element 204 is generally of a circular configuration, and it includes a pair of planar outer surfaces.

A pair of clacker elements 210 and 220 is secured to the central clacker element 204. The clacker elements 210 and 220 are not planar, as are the other clacker elements discussed above. Rather, the clacker elements 210 and 220 are of a partial spherical configuration. The clacker element 210 includes an inner planar face or side 212, and an outer convex surface or side 214. A central aperture 216 extends through the clacker element 210.

The clacker element 220 is substantially a mirror image of the clacker element 210. The clacker element 220 includes a planar side or face 222 and an outer convex surface 224. A central aperture 226 extends through the element 220.

The apertures 216, 206, and 226 are appropriately aligned with each other and the fastening element 230 extends through the aligned apertures to secure the clacker elements together.

In phantom in FIG. 9 is a curved line 213, defining a concave inner surface for the clacker element 210. If desired either or both of the clacker elements 210 and 220 may include such inner concave surfaces to enhance the sound or the appearance of the clacker apparatus 200.

Referring to FIGS. 1, 3, 5, 7, and 8, it will be noted that different designs are illustrated on the outer clackers. In FIG. 1, a football helmet design 240 is shown. Obviously, the football helmet design may be appropriately drawn and colored to represent any particular football team, as desired. Moreover, while the clacker elements 14, 20, and 30 are illustrated as being circular, they could easily be configured in the shape of a football helmet if desired.

In FIG. 3, the international olympic symbol of five interlocking rings 250 is illustrated on the bosses 72 and 82. Again, any desired design could be utilized on the outer clacker surfaces.

The configuration of the clacker elements of the clacker apparatus 100 has a flag type configuration 260. Symbolically, the United States flag is illustrated in FIG. 5 as the flag configuration 260 on the outer surface of the clacker element 100. Obviously, any desired flag could be used, whether it be a national, state, or any other appropriate type of flag.

Clacker apparatus 140 of FIG. 7 has been described as having a configuration 270 of a shield. Again, any configuration may be utilized. The term "Jones" on the shield face, with decorative lining, is merely symbolic of any desired name, individual, company, etc. which may be used.

Clacker apparatus 200 of FIGS. 8 and 9 appears to be in the general configuration, or is a representation, of a baseball 280. The term "Yankees" is shown in FIG. 8. It will be obvious that any baseball or softball team name could be named. Moreover, the circular "ball" configuration 280 of the clacker elements 210 and 220 could obviously represent a basketball, with appropriate markings, etc., and a basketball team's name could be placed thereon, etc.

Instead of a round configuration for a baseball or basketball or volleyball, the configuration of the apparatus of FIG. 8 could be in the shape of a football. Moreover, the general "ball" configuration need not include and outer convex surface. Rather, the circular configuration shown in FIGS. 1, 2, and 3, with planar outer sides or faces, could also be appropriately decorated be resemble a ball of some type. Again, a football shape with planar sides could also be used.

It is obvious that any desired configuration may be utilized for the various clacker elements. Moreover, it is obvious that rather than having a central or base clacker element and a pair (2) of outer clacker elements secured on opposite sides of the central element, it may be desirable under some circumstances to provide only a single outer clacker element. And, as noted above, the clacker elements may be secured together at the top, at the bottom, along an edge, or in the middle.

The outer clacker elements move generally parallel to the central or base clacker elements as the handle is moved. However, the movement of the outer clacker elements also includes a pivoting movement, in conjunction with the parallel movement. Accordingly, the relative movement is a combination of parallel and pivoting movements. As indicated above in conjunction with the discussion of the clacker apparatus 60 of FIGS. 3 and 4, the bevelling of the inner edges of the outer clacker elements adjacent to the fastening element enhances the pivoting movement. The parallel movement is enhances by the length of the fastening element(s) with respect to the overall thickness of the three clacker elements and the relative diameters of the apertures in the clacker elements and the fastening elements(s). The looser the clacker elements, with respect to the fastening element or elements, the greater the freedom to move and thus to enhance the clacking sound as the apparatus is shaken by a user. Also, the longer the distance the elements may move, also the greater the enhancement of the clacking sound.

Figure 10:
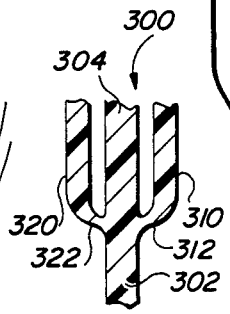
FIG. 10 is a side view of a portion of another embodiment of the apparatus of the present invention.

FIG. 10 is a side view of a portion of another alternate embodiment of the apparatus of the present invention. The FIG. 10 embodiment comprises clacker apparatus 300 which is of an integral design.

Clacker apparatus 300 includes a handle 302 and three clacker elements. The clacker elements include a central clacker element 304, an outer clacker element 310, and an outer clacker element 320. The central or center clacker element 304 extends upwardly from the handle 302, to which it is secured. The clacker elements 310 and 320 are secured to the handle 302 by living hinges i.e., the hinges are integral with the handle 302 and with the clacker elements 310 and 320, as shown. A living hinge 312 secures the clacker element 310 to the handle 302, and a living hinge 322 secures the clacker element 320 to the handle 302.

The living hinges 312 and 322 allow the outer clacker elements 310 and 320 to move relatively freely with respect to the handle 302 and the central clacker element 304. The movement of the outer clacker elements 310 and 320 still comprises the combination of pivoting and parallel movement to effect the clacker function. The overall length of the living hinges 312 and 322 is sufficient to allow the desired movement, and thus obtain the desired functioning, of the clacker apparatus 300. At the same time, the living hinges 312 and 322 provide sufficient rigidity and, due to the particular design of the living hinges, maintain the clacker elements 310 and 320 disposed generally parallel to the central clacker element 304 in their rest position. FIG. 10 shows the outer clacker elements 310 and 320 in their "rest" position.

As discussed above, the clacking sound may be enhanced in various ways, such as by including apertures extending through the base clacker element, or through the outer clacker elements, or through one of the outer clacker elements, by bosses and relieved portions in one or both outer clacker elements, etc. Moreover, if desired, the outer clacker elements may be configured in other than a planar configuration, such as is shown in the embodiment of FIGS. 8 and 9. Also, such convex outer configuration as shown in FIG. 9 may be enhanced by a concave inner configuration, if desired.

While the principle of the invention have been made clear in illustrative embodiments, there will be immediately obvious to those skilled in the art many modifications of structure, arrangement, proportions, the elements, materials, and components used in the practice of the invention, and otherwise, which are particularly adapted to specific environments and operative requirements without departing from those principles. The appended claims are intended to cover and embrace any and all such modifications, within the limits only of the true spirit and scope of the invention.

What I claim is:

1. Clacker apparatus, comprising, in combination:

a base clacker element having first and second sides;

a handle secured to the base clacker element;

outer clacker element means secured to the base clacker element, including at least a single outer clacker element disposed on one of the sides of and adjacent to the base clacker element and movable in a combined movement while being generally parallel towards and away from the base clacker element and pivoting against and away from the base clacker element, said pivoting for producing a desired sound; and means for securing the base clacker element and the outer clacker element means together, said means allowing for either generally parallel or pivoting movement of said outer clacker element means relative to said base clacker.

2. The apparatus of claim 1 in which the means for securing the base clacker element and the outer clacker element means together includes aligned apertures in the base clacker element and in the outer clacker element means and fastening means extending through the aligned apertures.

3. The apparatus of claim 1 in which the aligned apertures have a first diameter and the base clacker element and the outer clacker element means have a first combined thickness, and the fastening means includes a fastening element having a shaft having a diameter less than the first diameter and a length greater than the first combined thickness to allow the outer clacker element means to move relative to the base clacker element.

4. The apparatus of claim 3 in which the means for securing the base clacker element and the outer clacker elements together includes a pair of fastening elements.

5. The apparatus of claim 1 in which the outer clacker element means includes a first outer clacker element and a second outer clacker element, and the first outer clacker element is disposed on the first side of the base clacker element and the second outer clacker element is disposed on the second side of the base clacker element.

6. The apparatus of claim 5 in which the means for securing the base clacker element and the outer clacker elements together comprises a first fastening element and a second fastening element generally parallel to the first fastening element.

7. The apparatus of claim 5 in which the means for securing the base clacker element and the outer clacker elements together comprises a single fastening element.

8. The apparatus of claim 1 in which the base clacker element includes a sound enhancing aperture.

9. The apparatus of claim 1 in which the outer clacker element means includes a relieved portion facing the first side of the base clacker element.

10. The apparatus of claim 1 in which the outer clacker element means includes a first side facing the first side of the base clacker element and a second side remote from the base clacker element, and a boss extending outwardly from the second side of the outer clacker element means.

11. The apparatus of claim 10 in which the first side of the outer clacker element means includes a relieved portion facing the first side of the base clacker element.

12. Clacker apparatus, comprising, in combination:

base clacker means, including a base clacker element for making noise;

outer clacker element means secured to the base clacker means and movable, while being generally parallel, in a towards and away movement and in a pivoting movement with respect to the base clacker element as the base clacker means is moved by a user for making noise in conjunction with the base clacker element; and fastening means for securing together the base clacker means and the outer clacker element means for the towards and away movement and pivoting movement of the outer clacker element means with respect to the base clacker means, said fastening means including a shaft on which the outer clacker element means moves, and said shaft moves relative to the base clacker means.

13. The apparatus of claim 12 in which the fastening means includes a first and a second fastening element spaced apart from each other.

14. The apparatus of claim 12 in which the base clacker means includes a first thickness, and the outer clacker element means includes a second thickness, and the fastening means includes a first length, which first length is greater than the combined first thickness and second thickness to allow the outer clacker element means to move relatively freely with respect to the base clacker means.

15. The apparatus of claim 14 in which the fastening means further includes an aperture in the base clacker means having a first diameter and aperture means in the outer clacker element means having a second diameter, and the shaft of the fastening means has a third diameter, and the third diameter of the shaft is less than the first and second diameters of the base clacker means and the outer clacker element means to allow the outer clacker element means to move relatively freely with respect to the base clacker means.

16. The apparatus of claim 1 in which the fastening means comprises living hinges.

17. The apparatus of claim 12 in which the base clacker means further includes a handle secured to the base clacker element for allowing a user to hold and move the base clacker element and the outer clacker element means secured to the base clacker means.

18. The apparatus of claim 17 in which the outer clacker element means includes a first outer clacker element disposed generally parallel to the base clacker element.

19. The apparatus of claim 18 in which the outer clacker element means further includes a second outer clacker element disposed generally parallel to the base clacker element and to the first outer clacker element.

20. The apparatus of claim 19 in which the base clacker element has a first side and a second side, and the first outer clacker is disposed adjacent to the first side and the second outer clacker is disposed adjacent to the second side.

* * * * *